United States Patent [19]

Spanel et al.

[11] 4,317,419

[45] Mar. 2, 1982

[54] METHOD, MEANS, AND TUFTED PRODUCT

[75] Inventors: Abram N. Spanel, 344 Stockton St., Princeton, N.J. 08540; David R. Jacobs, New Canaan, Conn.

[73] Assignee: Abram N. Spanel, Princeton, N.J.

[21] Appl. No.: 188,918

[22] Filed: Sep. 9, 1980

Related U.S. Application Data

[62] Division of Ser. No. 71,164, Aug. 30, 1979, Pat. No. 4,244,309.

[51] Int. Cl.[3] ..... D05C 15/00

[52] U.S. Cl. ..... 112/266.2

[58] Field of Search ..... 112/410, 266.2, 79 R

[56] References Cited

U.S. PATENT DOCUMENTS 2,928,099 3/1960 Moonan et al. ..... 112/410

3,583,346 6/1971 Bloch et al. ..... 112/410

*Primary Examiner*—Ronald Feldbaum

*Attorney, Agent, or Firm*—Steele, Gould & Fried

[57] ABSTRACT

A tufting method and apparatus for tufting yarn to a backing layer, including individual tufting elements, comprising, means to select when tufting elements will be utilized during a tufting operation, means to select particular yarns from a plurality of yarns, for tufting, means to select the length of yarn increment to be tufted, means to control the distance between successive needle strokes, and means to control lateral displacement of successive needle strokes.

9 Claims, 15 Drawing Figures

FIG 3A
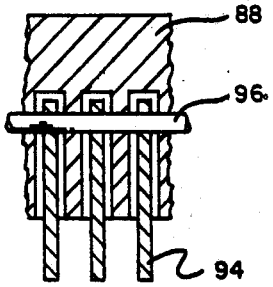
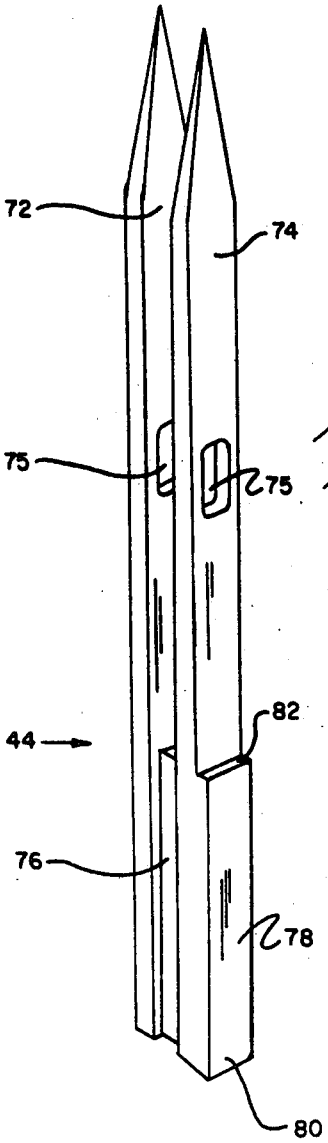
FIG 4A
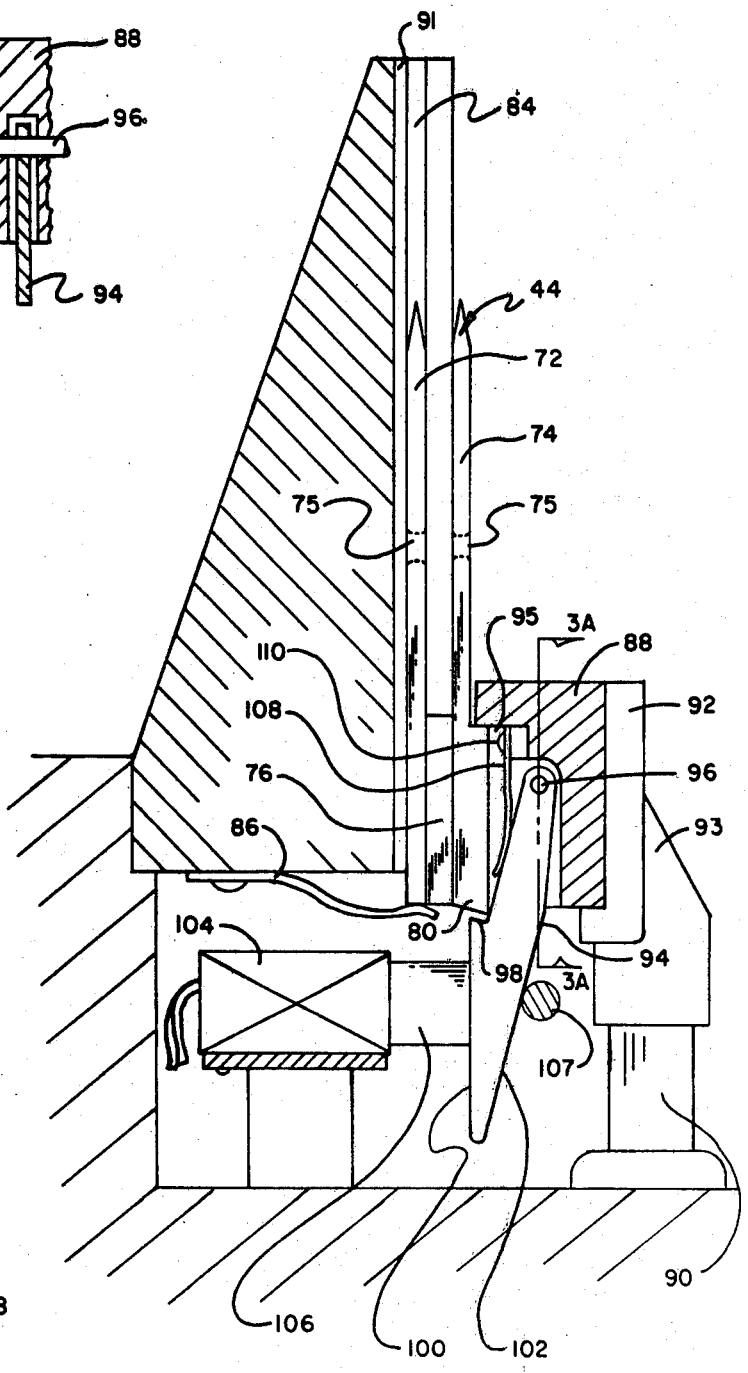
FIG 4

METHOD, MEANS, AND TUFTED PRODUCT

This is a division of application Ser. No. 071,164, filed Aug. 30, 1979, now U.S. Pat. No. 4,244,309.

BACKGROUND OF THE INVENTION

The subject disclosure relates to an improved method and apparatus for tufting to enable the production of an improved tufted product hithertofore not obtainable from commercial tufting machines.

In recent years the "Spanel Tufting System" involving multi-color tufting has been developed under the direction of Abram N. Spanel, a coinventor of the subject disclosure. Multi-color tufting has been a primary objective of the system with the purpose to enable the tufting of different color yarns for each tufting stroke. Under such a system, the production of detailed colored pictorials can be readily accomplished since yarn selection means can be included to choose a particular yarn from a plurality of yarn choices for each of the tufting strokes. With a "Spanel" tufting machine having on the order of 1200 needles, if there is a choice of, for example, five or eight colors for each needle stroke of the 1200 needles, it readily can be appreciated that a painting or other picture can be precisely and accurately reproduced in the form of a tufted product.

More precisely, the Spanel system utilizes pneumatic means to transport yarn to tufting stations, either in metered lengths of unsevered yarn or discrete yarn bits. The yarn is then tufted by needle or other bit-applying means to a backing layer to form a tufted product such as a rug.

Aspects of the Spanel system are disclosed in U.S. Pat. No. Re. 27,165 and U.S. Pat. No. 3,554,147, such as the concept and fundamental apparatus for selecting one of an array of yarn color strands and then transporting the yarn strand or a severed yarn bit to a needle station for tufting. A number of Spanel improvement patents disclose improved means of selecting yarn for the tufting stations. Basically, however, in the Spanel patents, regardless of the type of yarn selection system, yarn strands were metered by metering devices and fed pneumatically to a magazine or collator with multiple section yarn tubes either leading directly to tufting stations or merging into a common passageway leading to the tufting stations. The metering device in the aforementioned U.S. Pat. No. 3,554,147 includes yarn brakes and yarn pullers which are individually actuated but which co-act to meter a length of yarn for yarn selection. Thus these Spanel patents disclose apparatus to select and meter a length of yarn for each of the needle stations.

It now has been discovered that certain other developments when incorporated with the early Spanel techniques can be utilized to produce a product formerly not thought possible on a full-size commercial tufting machine. As will be discussed, these advances create a machine of precise exactitude which will effectively enable the positioning of all needle strokes, including the elimination of strokes to control density with the final product being a finely engineered tufted product superior to any other machine-made product.

The advancement over commercial machines of today, which attempt to control density is striking. Currently, density in most tufted products is controlled by the use of a pattern reader. A typical means of controlling pattern definition is the universal type patent attachment (UTPA) which comprises a series of knurled rolls that run in concert with each other. The rolls, which run at varying speeds, are a combination of knurled and smoothly polished members.

Specifically, a first roll will have areas of heavy knurls alternating with areas which are smoothly polished. A second abutting roll that is to run at a different speed from the first has exactly the same type alternating surface finish, except the polished areas are disposed opposite from the knurled areas of the first roll, and the knurled areas opposite the polished. A deflector finger is positioned above the two rolls which deflects the yarn to the right or left to pick up high or low speed to enable a high and low pattern. This pattern becomes a mirror image since a first yarn is taken from the rolls to the right hand side of the machine and the second yarn to the left hand side within the capability of yarn selectors. A product can thus be obtained with no repeat from the center line to one side of the rug, however, the exact pattern will be produced on the other side of the rug. It will be appreciated that in such a conventional tufting machine since the yarn must be threaded continuously in the tufting needles, precise control of density is impossible since the length of each tuft can not be controlled with each descending needle stroke.

Furthermore, as will be discussed in detail, while present day patterning techniques are limited to high-low tuft production, in the Spanel operation disclosed herein, in addition to controlling the length of yarn for each needle stroke, it is also possible to control the type needles to be used, whether an individual needle is used, or whether a particular needle is fed yarn even if the needle is automatically being used. For example, if a shag carpet is being tufted and in view of the length of the yarn tuft it is desired to reduce the yarn density, a needle can be removed from operation as disclosed herein or the tuft strokes can be carried out with unthreaded needles.

Thus, the subject specification will disclose the apparatus and method to tuft with all 1200 needles, or every second or third needle if desirable. Such capability does not exist in present day commercial machines since the needles are threaded continuously with yarn and are driven by a needle bar which constantly reciprocates.

For example, if a carpet mill is running a five-sixteenths inch gauge carpet and it is desirable to run a five-eighths inch gauge carpet, it is necessary to seize and cut every other yarn which extends to the needles and tie the cut ends to the header bar. In each such machine, there are approximately 608 ends of yarn leading into the machine from the creel and accordingly, approximately 304 must be removed. These yarns must also be unthreaded from the yarn feed rolls and from the needles with care being taken to ensure that the proper yarns are removed. When it is desired to return to running five-sixteenths inch gauge carpet, the needles and feed rolls must be rethreaded, thus in practice, because of time considerations usually such machine changes are not made. Furthermore, it will be realized that changes cannot be made while the machine is running and accordingly, the production of a rug having total control of multiple levels of tufts is not possible by present commercial techniques. On the other hand, as disclosed in the subject specification, it becomes possible to not only quickly change the length and type of tuft for each needle station while eliminating tufting at certain stations, but such change may also be effectuated during the tufting of a single carpet.

The product of the subject disclosure can further be improved over prior art products by the ability to precisely control feeding of the backing layer. The backing layer of the subject disclosure is advanced incrementally and this advancement can be controlled so as to lengthen the distance between successive needle strokes as is desirable in the case where shag carpet is being tufted. In contrast most conventional tufting operations utilize uncontrollable continuous feed of the backing layer.

Additionally, a backing shifter is disclosed herein to enable the lateral shifting of the backing layer. Backing shifters per se are well known in the carpet industry with the first ones being called "wavy-line" units. An eccentric wheel as used with an adjustable slot in the middle to enable adjustment of the shift to be made and once adjusted, the machine was permitted to keep running to produce what was known as wavy-line carpet. Such a procedure became well known with chenille bedspreads.

As used herein, the backing shifter is used to supplement needle positioning which is a function of the control of yarn density. With programming and complete adjustability of the backing shifter, it will be appreciated that not only is the ability available to select the use of needles, and the type and size of yarn to be tufted, but also by virtue of the backing feeding and backing shifting control, the precise location or placement of the needles into the backing layer is obtained.

The improvements with the backing shifter of the subject disclosure can best be appreciated by viewing the use of backing shifters in conventional tufting machines. Conventional tufting machines, usually have needle plates placed below the needles with yarn being fed downwardly therethrough. In a conventional loop pile machine, the tuft hook is positioned below the needle plate. The backing flows over the top of the needle plates with backing fingers being used to support the backing and support the penetration load of the needles. Since the loops are continuous as they are formed on the face below the backing, it is not possible to effectuate the backing shift in the needle area because of the needle plate location. Accordingly, in a conventional tufting machine, the pin roll which is used is positioned at a distance permitting tangential engagements of the backing layer only. Thus, with the pin roll placed approximately two and a half inches from the needle location, it is necessary to move the backing approximately three-quarters of an inch to achieve a three-sixteenths inch movement at the needles. This is due to both the location of the pin rolls and the natural drag which is encountered because the loops are hooked onto the needle plate fingers in the proximity of the needle station.

As disclosed herein, since the pin roll is placed in close proximity to the needles, backing layer control very close to the needle station can be achieved. In view of this positioning of the pin roll, since there is no drag because of the nature of the tufting operation, it is geometrically predictable precisely how far the backing layer will move adding to the ability to precisely control a tufted product. Further, in the subject specification, the backing layer is advanced incrementally as distinguished from the conventional machine where the backing is in continuous motion creating a much higher drag factor.

SUMMARY OF THE INVENTION

Accordingly, it is an overall object of the subject invention to provide a method of tufting and tufting apparatus which will produce precisely controlled and engineered tufted carpet with complete color and density control. With such apparatus a multicolored pictorial in the form of a tufted carpet can be produced which is not only color controlled but finely sculptured to produce a three dimensional appearance previously not obtainable. Various improvements have been developed to enable functions of the machine to be carried out in concert to enable the achievement of the general objects of the subject invention.

It is a more specific object of the subject invention to combine means to select tufting elements with means to select particular yarns including the length thereof for each of the needle strokes. Furthermore, it is an object of the subject invention to control the distance between successive needle strokes along with controlling lateral displacement of the successive needle strokes.

It is another specific object of the subject invention to provide a system in which certain tufting elements can be utilized while others are eliminated effectively or actually from usage during a particular segment of the tufting operation.

It is a further specific objective of the subject invention to provide a backing control system with unequaled control to precisely position the backing layer before each tufting step occurs.

It has become an overall objective of the subject invention to develop the above mentioned aspects of the invention to be compatible with the Spanel tufting system so that control of density and sculpturing effect can be combined with the multi-color capability as disclosed in earlier Spanel patents.

BRIEF DESCRIPTION OF THE DRAWINGS

For a more detailed understanding of the invention, reference is made in the following description to the accompanying drawings in which:

FIG. 3A is a section view of the drive bar taken along 3A—3A of FIG. 3;

FIG. 4 is a plan view of the needle selection means of FIG. 3;

FIG. 4A is an isometric view of the needle construction of the embodiment of FIG. 3.

Figure 3:
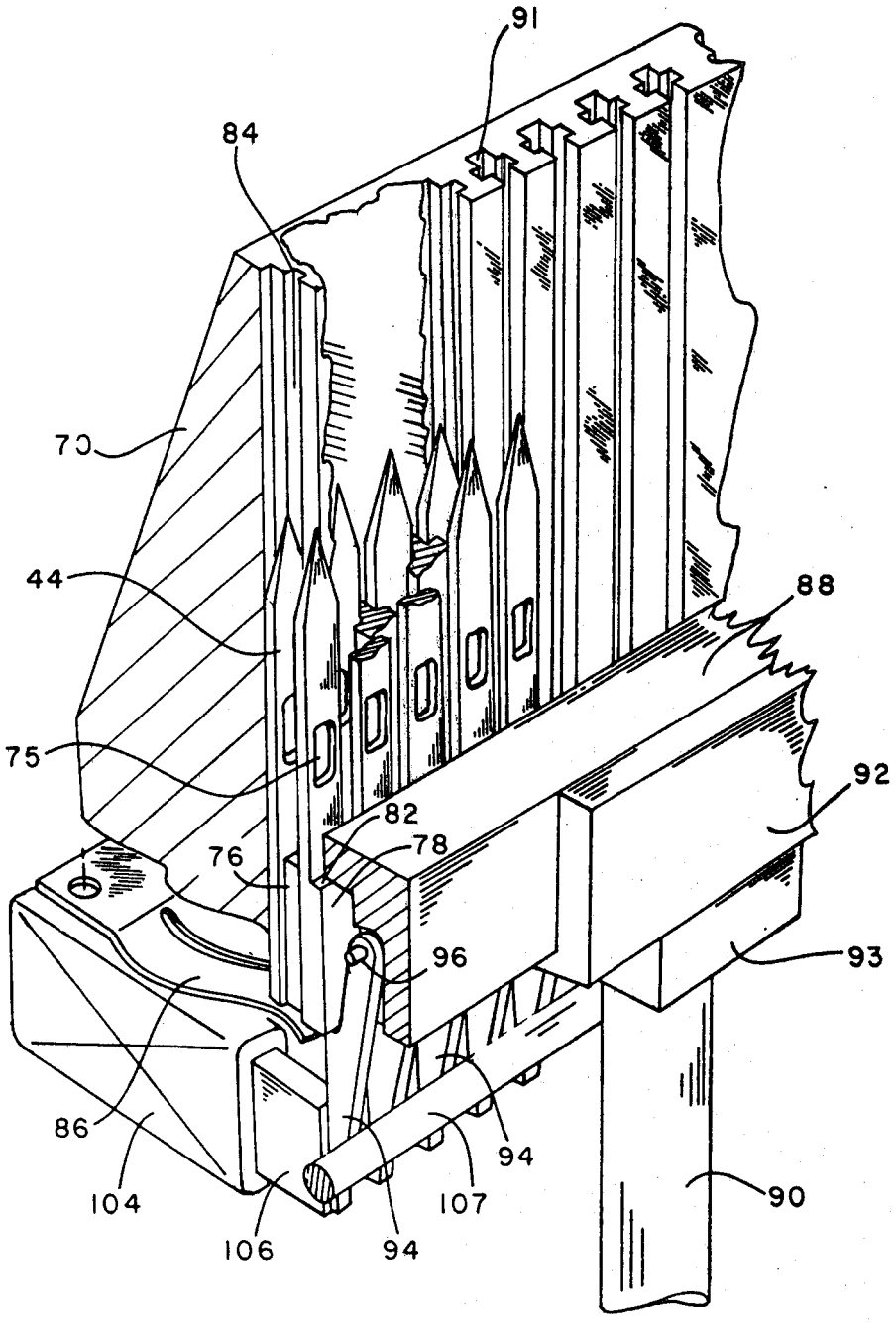
FIG. 3 is an isometric plan view of an embodiment of a needle selection means of the subject tufting machine.
Figure 7A:
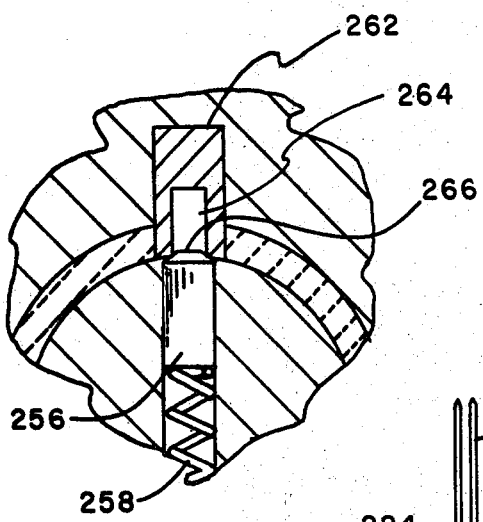
FIG. 7 is a plan view of a needle station of the embodiment of the needle selection means of FIG. 6.
Figure 7:
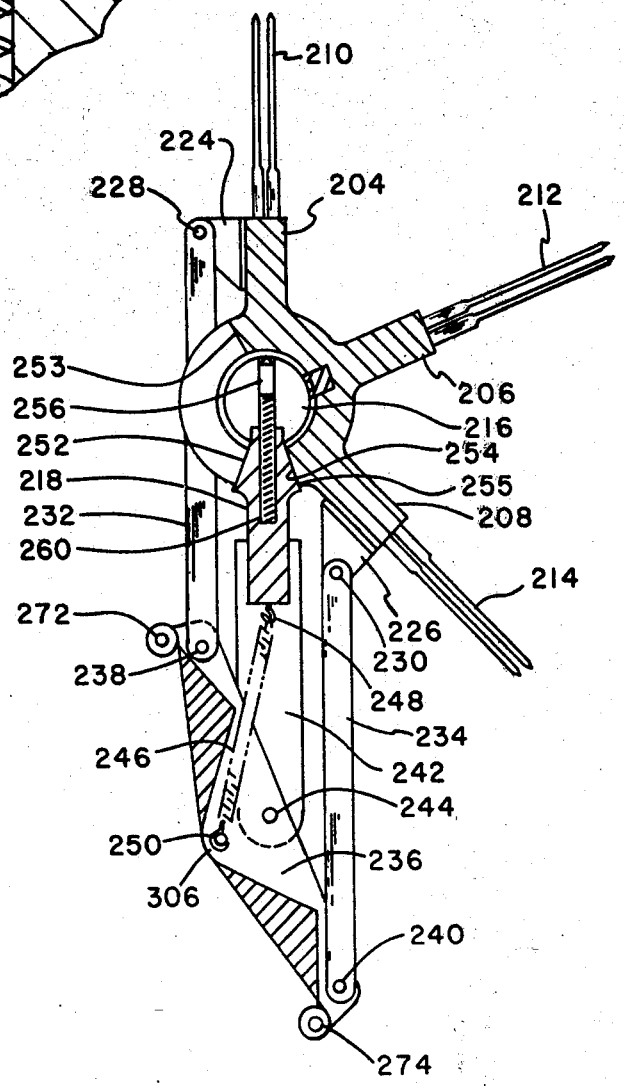
Figure 8:
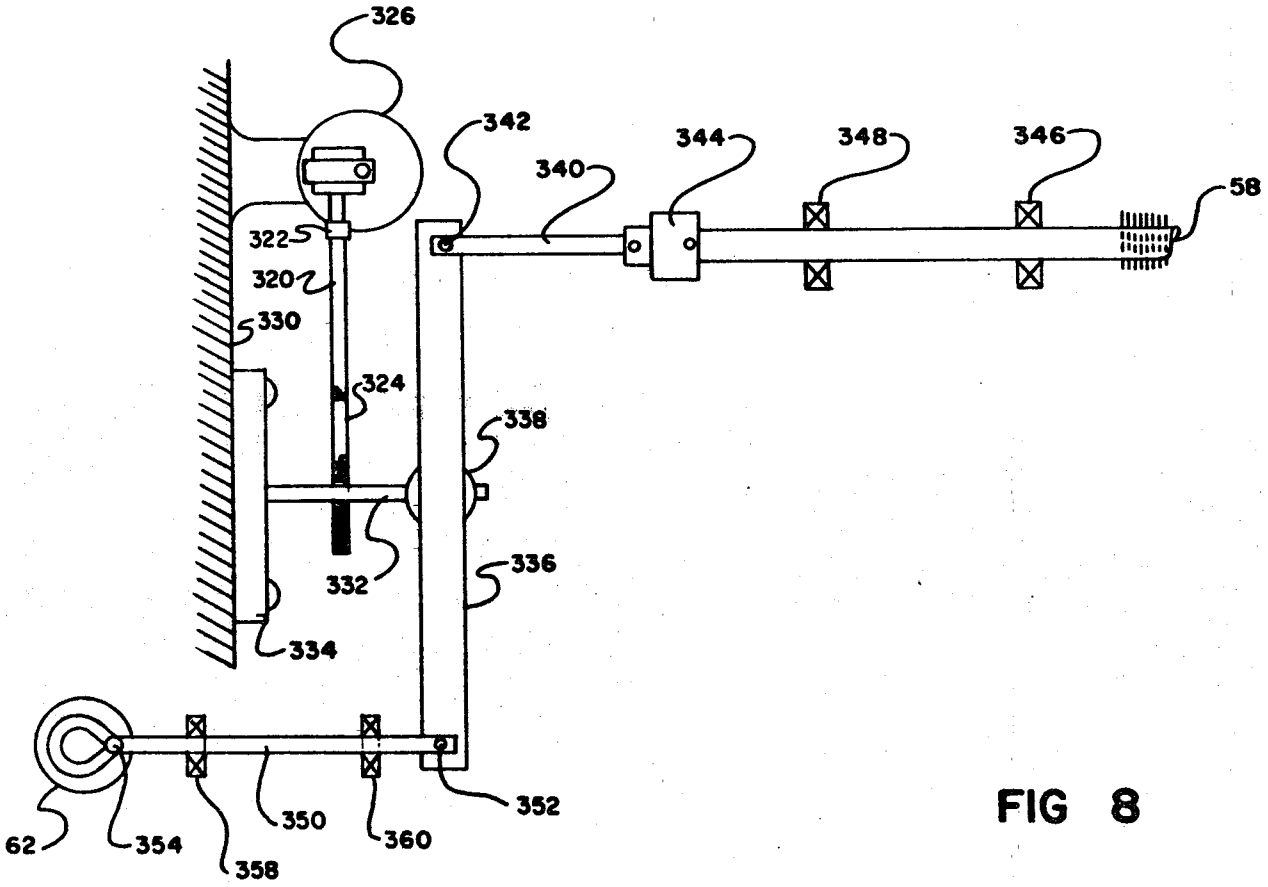
Figure 10:
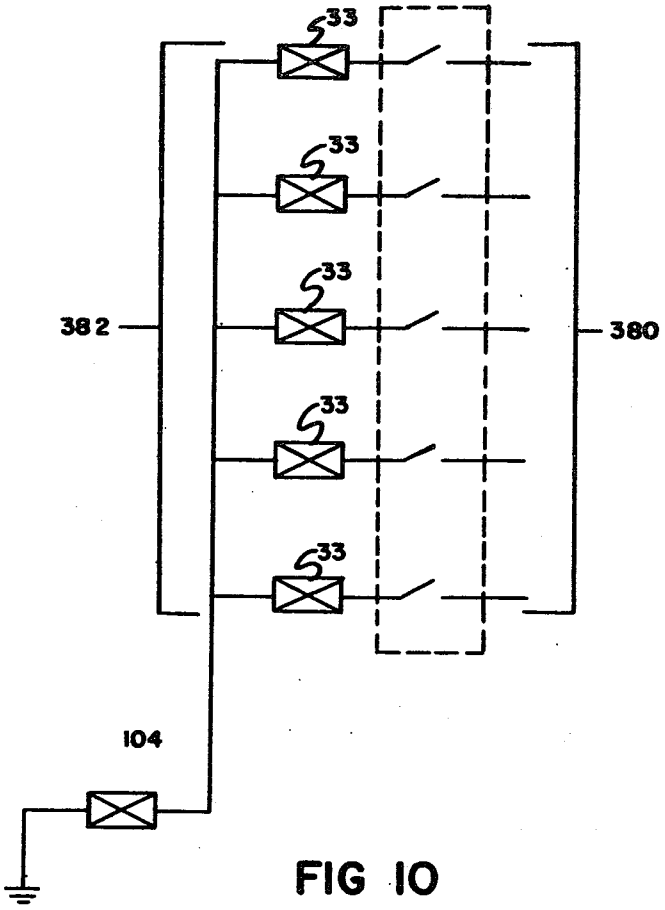
Figure 9:
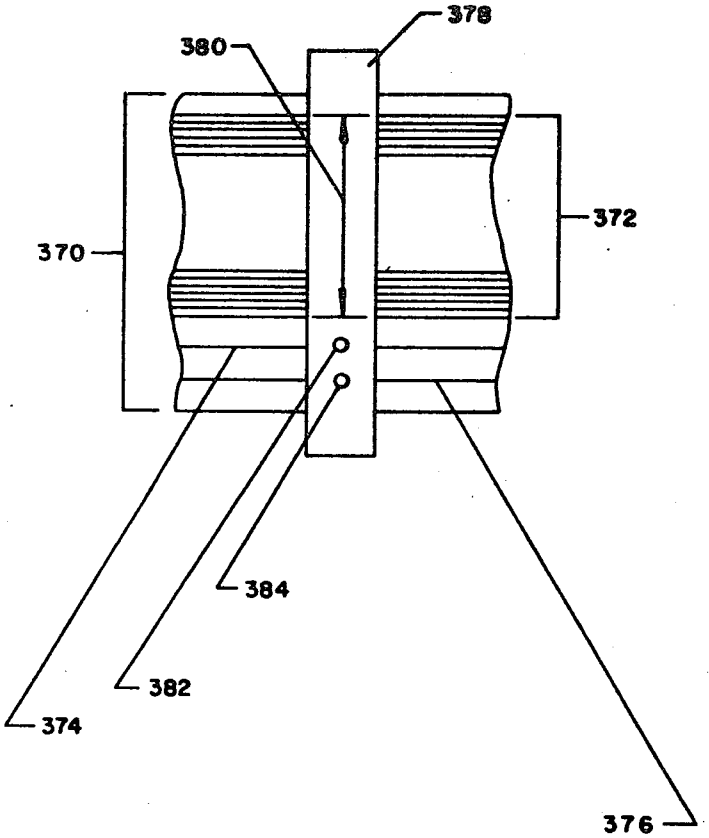
Figure 11:
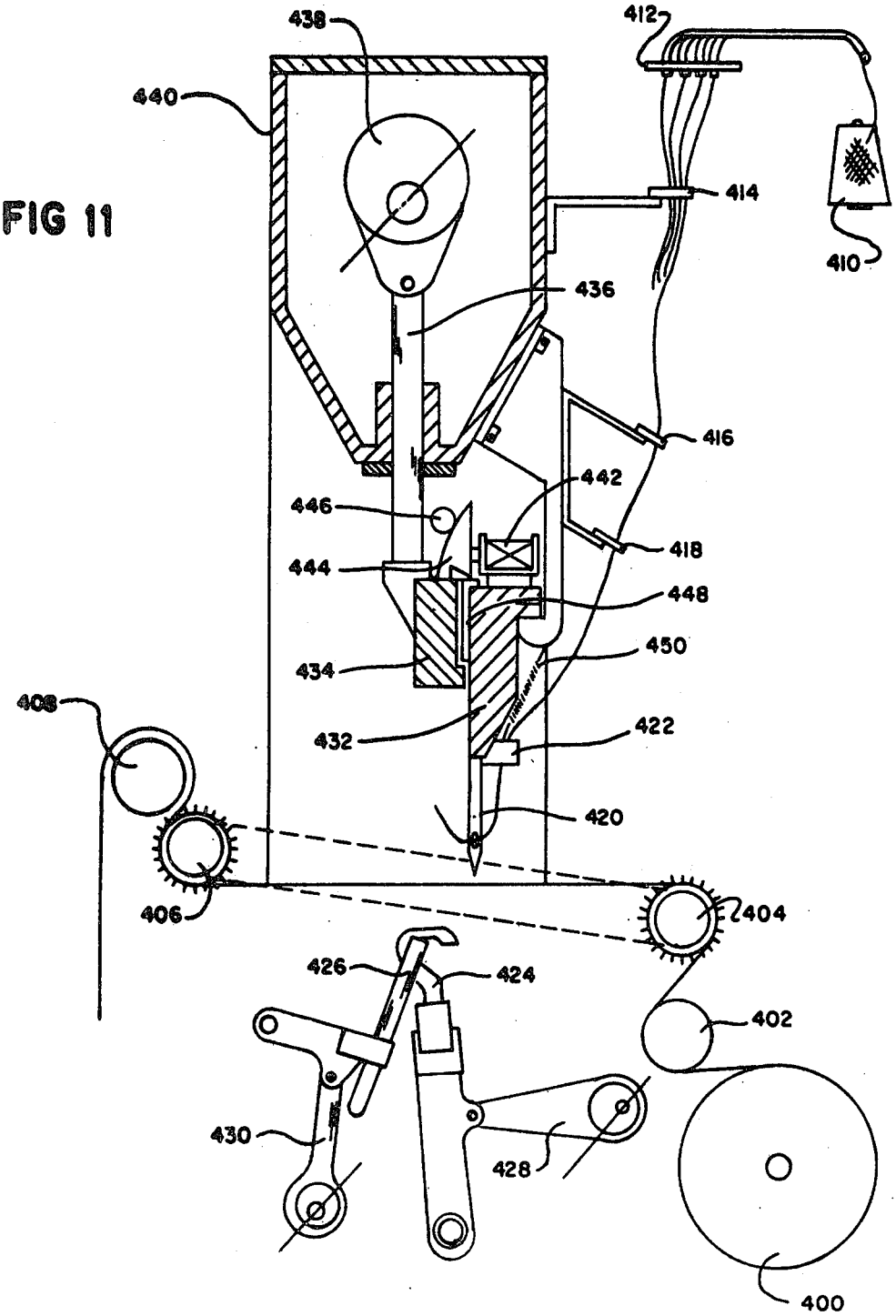

FIG. *7a* is a partial plan view of a portion of the mechanism of the embodiment of FIG. 7;

FIG. 8 is a schematic view of a backing shifting mechanism;

FIG. 9 is a functional block view of a patterning device for the tufting machine described herein;

FIG. 10 is a functional block view of the electronic yarn feed and needle control; and FIG. 11 is a schematic view of the needle section embodiment of FIG. 3 as adapted for a conventional tufting machine.

DETAILED DESCRIPTION

Figure 1:
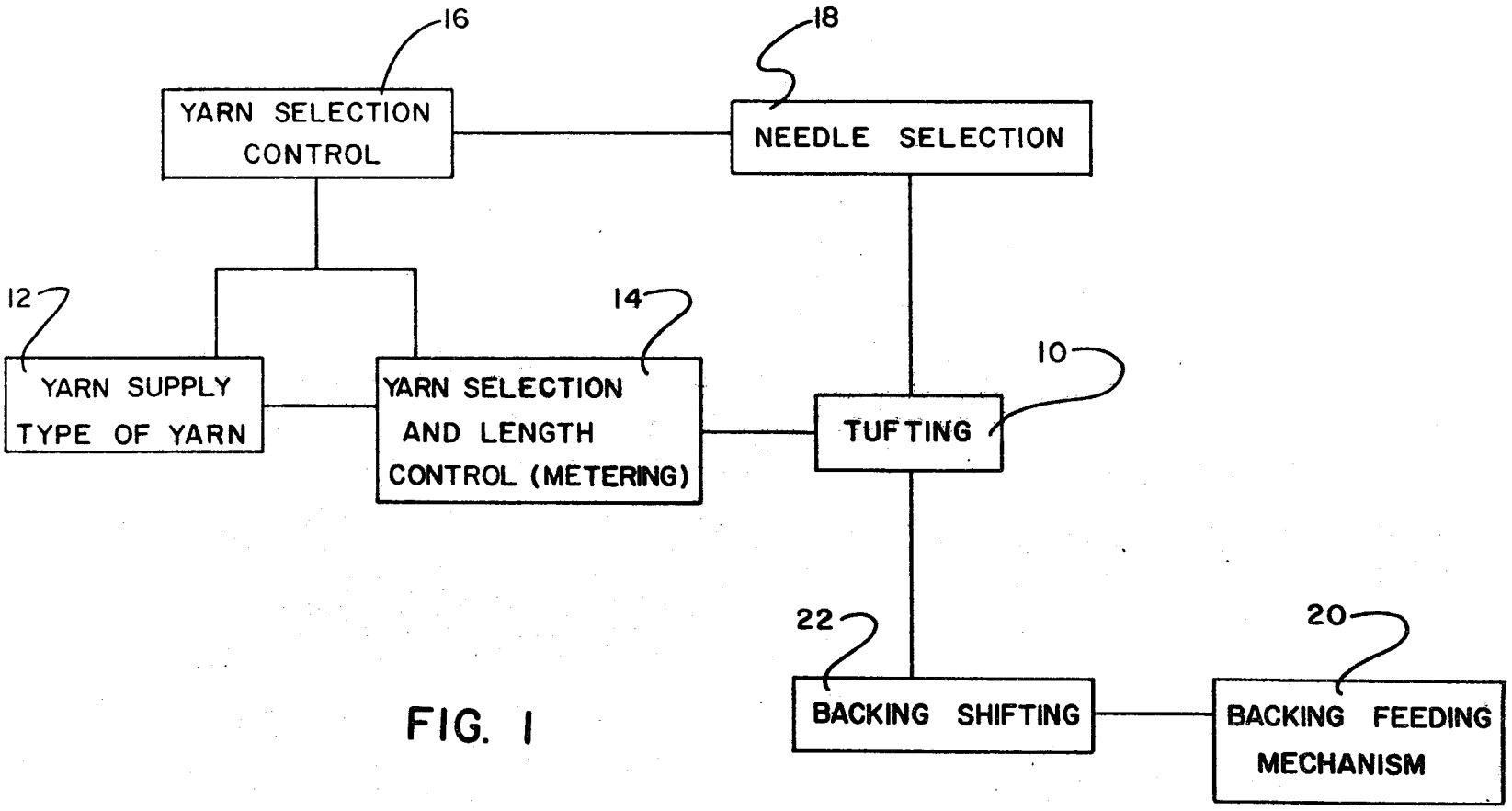
FIG. 1 is a block diagram showing the basic elements of a tufting machine as described herein.

With reference to FIG. 1, a block diagram is shown broadly setting forth the major elements of the subject application. The tufting station 10 is shown which, as will be described in detail, comprises a series of individual tufting elements which may be on the order as described in aforementioned U.S. Pat. No. Re. 27,165.

A yarn supply 12 is shown to the left of the tufting station 10 which may comprise a series of yarn bobbins per each of the tufting elements. With the machine of the preferred embodiment, it is contemplated that 1200 needles will be used with each needle station having the selection capability of five or eight types or colors of yarn. Accordingly, the yarn supply area 12 may include a yarn creel system having as many as 6,000 yarn bobbins.

Adjacent yarn supply 12 is a block designated yarn selection and length control (metering) 14. This designates the area in which the yarn metering operation is to take place. The yarn metering system may be on the order of that disclosed in aforementioned U.S. Pat. No. 3,544,147 or it may be on the order as disclosed in U.S. Pat. Nos. 3,937,157 and 4,047,491.

A yarn selection control mechanism 16 is shown connected to yarn supply 12 and yarn selection and length control 14. A number of different types of yarn selection systems are contemplated depending upon the type of carpet desired and the level of sophistication necessary to produce the desired result. For example, the yarn selection control may comprise a scanning apparatus to gather data from a pictorial to be reproduced and transform the data into the necessary signals for selecting the particular color of yarn to be used in the pattern to be reproduced. In like manner, yarn density may be controlled by selecting yarn of a particular denier and further calling for a specified length of such yarn for each of the tufting strokes.

A needle selection mechanism 18 is disclosed which enables the selection of certain of the needles for tufting in a particular operation. For example, when lengthy shag carpet is to be produced, fewer needles are necessary and, accordingly, fewer needles may be placed in operation or certain needles need not be fed yarn. It will be appreciated that needle selection is interrelated with yarn selection control with the operation of each occurring in concert.

A backing feed mechanism 20 is shown which will control the incremental feeding of the backing so that various distance between placement of successive rows of needles may be controlled. This is likewise important for a machine which will make a plush short-tuft carpet in one run and make a shag carpet in the next production run or alternatively combine both operations in a single rug.

Figure 2:
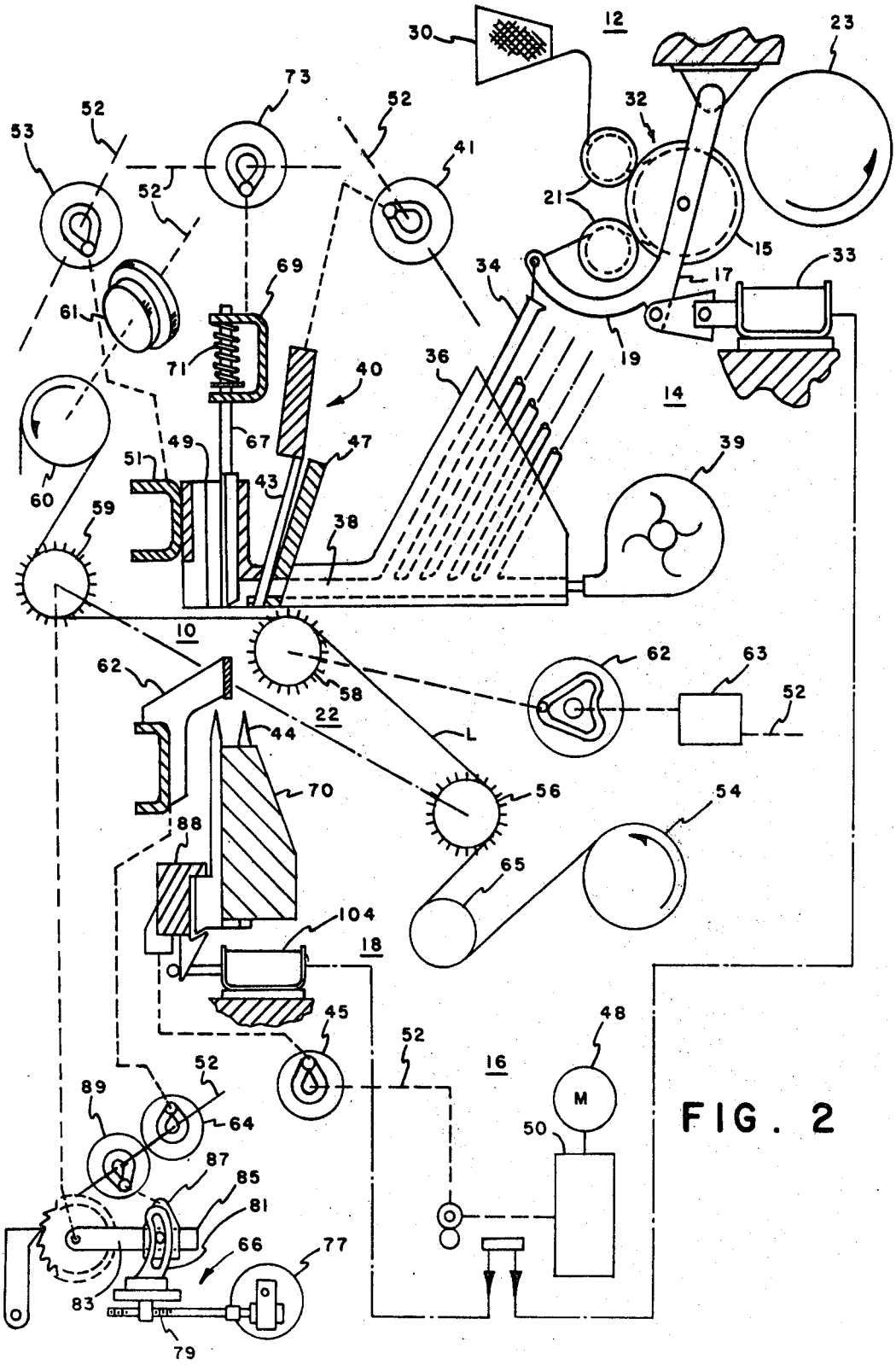
FIG. 2 is a schematic overall view of the tufting machine of FIG. 1.

With reference to FIG. 2, a schematic view of one operational unit of an embodiment of the tufting apparatus disclosed herein is shown. A creel station is shown comprising yarn bobbins 30, one of which is shown, from which yarn can be supplied to tufting stations. A yarn metering system 32 may be on the order as disclosed in U.S. Pat. Nos. 3,554,147, 3,937,157 or 4,047,491. Actuation means which may be solenoids 33 or other suitable means are shown connected to the yarn metering system 32.

Pneumatic yarn transportation tubes 34 are shown leading from each individual yarn metering system 32 to a yarn collator 36 where the individual yarn transportation tubes 34 merge into a common yarn transportation tube 38 leading to the tufting station 10. A pneumatic source 39 schematically shown provides the pneumatic supply for the pneumatic transport of the yarns. Yarn severing means 40 on the order of that disclosed in U.S. Pat. No. 4,119,047 is shown being controlled by cam member 41 while needles 44 are shown being driven by cam member 45. The severing means 40 comprises a moving blade 43 which coacts with a stationary blade 47 as fully described in U.S. Pat. No. 4,119,047. The needles 44 may be dual shank needles having aligned eyes on the order of those disclosed in aforementioned U.S. Pat. Nos. 3,554,147 and RE. 27,165. In accordance with the method of tufting disclosed in the aforementioned patents, a discrete length of yarn is placed through the aligned eyes of the needle shanks to be tufted into a backing layer.

In place of needles 44, stomper-like bit-applying elements as disclosed in U.S. Pat. No. Re 27,165 may be used to push the yarn into adhesive attachment with a backing layer L.

A motor 48 is shown driving the tufting apparatus through transmission 50 which may be a train of gears or related mechanism. A power transmission means 52 is schematically shown running throughout the device from which the various drive mechanisms operate. As shown, yarn severing cam means 41 and needle cam means 45 operate off power transmission means 52.

The backing layer L onto which yarn is tufted is shown passing tufting needles 44. The backing layer L is fed from supply roll 54 to pin roll 56, around shifting roll 58 to pin roll 59 to the doff roll 60. The doff roll 60 is a rubber covered roll which is a type of roll used widely in the industry. It is controlled by magnetic clutch 61 operating off power transmission means 52 and its function is to pull the tufted material off the pin roll 59. The shifting roll 58 is shown being controlled by cam means 62 and transmission 63 as driven by power transmission means 52. A staging bar positioner 65 controls the angle of approach of the backing layer L to pin roll 56. The backing layer L is advanced incrementally as pin rolls 56 and 59 are driven off power transmission means 52 by cam 89. The control of the amount of backing layer advancement is through electric gear motor 77 which is shown in engagement with threaded rod 79 which is received by adjustment carrier 81. Ratchet 83 is driven by cam 89 through lever arm 85 and adjustable sleeve 87.

The pin feed rolls 56 and 59 are shown as being driven by adjustable feeding means 66 which operates off of transmission means 52.

With further reference to FIG. 2, the yarn feeding and metering system is shown having elements disclosed in U.S. Pat. No. 3,937,157. A rotatable yarn feed mechanism 15 is shown with intermediate linkage means 17. The intermediate linkage 17 extends from solenoid actuator 33 to the rotatable yarn feed mechanism 15 and also is shown controlling the yarn pull back mechanism 19 fully described in U.S. Pat. No. 3,937,157. The yarn feeding and metering mechanism 32 also includes yarn guides 21 and drive roll 23.

A yarn adjuster 49 is shown having yarn adjuster carrier bar 51 linked to eccentric member 53. The yarn adjuster 49 is fully disclosed in U.S. Pat. No. 4,127,078 and provides the tufting apparatus with the capability of selecting and tufting yarn of different lengths to produce tufts of different pile heights either on the same or different rugs.

Yarn bit clamps 67 are shown which clamp the yarn against backing layer L prior to tufting. The yarn bit clamps 67 shown having a bit clamp carrier bar 69, spring means 71, and cam driving means 73 are fully disclosed in U.S. Pat. No. 4,111,136.

As disclosed in U.S. Pat. No. 4,127,078, a shiftable support member 62 is provided opposite the clamps 67 to provide support for the backing layer L. The support member 62 is controlled by cam member 64 and is cleared from its support position as the backing layer L is advanced.

With reference to FIGS. 3 and 4, the needle pair assembly 44 is shown positioned adjacent stationary guide block 70. As shown in FIG. 4*a*, the needle pair assembly 44 comprises a front needle segment 72 and a rear needle segment 74 each having aligned eyes 75. These segments 72 and 74 are joined by connector web 76. Mounted at the base of rear needle segment 74 is abutment structure 78 which comprises a first drive engagement surface or selector latch lip 80 and a second drive engagement surface or drive step 82. As shown in position with respect to stationery guide block 70, front needle segment 72 is restrained and reciprocal within channel 84. Machine grooves 91 facilitate the manufacture of guide block 70. Overstroke spring 86 which will limit the downward motion of needles 44 and keep the needle base above selector key engaging structure (as will be described) is secured to the base of stationary guide block 70.

The needles 44 are driven by needle drive bar 88 which reciprocates as driven by push rod 90. A push rod foot 92 is shown securing needle drive bar 88 to push rod 90 through intermediate structure 93. The needle drive bar 88 is shown having selector keys 94 pivotally mounted thereto by continuous pivot rod 96 as best seen in FIG. 3A. Needle bar 88 has a drive surface or drive step 95 engageable with the drive step 82 of needle pair assembly 44.

The selector key 94 has an engagement notch surface 98 below which is a flat vertical pole surface 100. An angulated surface 102 forms the opposite lower side of selector key 94.

Selector coil 104 is shown having pole piece 106 positioned adjacent to the pole surface 100 of selector key 94. On the other side of the lower portion of selector key 94 a deflector bar 107 is positioned.

The needle drive bar 88 extends widthwise across the tufting machine with each needle assembly unit 44 having an individual selector coil 104. For each needle assembly unit 44 there is a corresponding individual selector key 94 mounted to the pivot rod 96 which also extends widthwise across the machine. For each selector key 94 there is a corresponding selector spring 108 shown mounted to the needle drive bar 88 by screw 110 or other suitable means.

In operation, if the use of a particular needle assembly 44 is desired, the corresponding selector coil 104 is energized and pole piece 106 will attract the metallic selector key 94 causing the pole surface 100 to be drawn to the pole piece 106. As the needle drive bar 88 rises as it is driven by push rod 90 during each machine cycle, the chosen selector key 94 will engage selector latch lip 80 by means of engagement notch surface 98 as selector key 94 overcomes the bias of selector spring 108. The bias of selector spring 108 is overcome by the magnetic attraction of solenoid 104 which draws selector key 94 to the left as shown in FIG. 4. While the deflector bar 107 urges all selector keys 94 into contact with the respective pole pieces 106, only the energized solenoids will hold the selector keys 94 in contact with the pole piece 106 to cause the energized selector key 94 to engage selected needle assembly 44. The deflector bar 107 keeps the pole surface 100 of selector key 94 close to pole piece 106 to enable the use of a small solenoid 104. Thus, as the needle bar 88 rises, the selected needle assembly 44 will also rise, it being contemplated that yarn will be loaded in the needle eyes 75 when needles 44 rise to the load position and that tufting will occur subsequently by needles 44. The needles 44 are returned at the completion of the tufting step as needle drive bar 88 returns to its down position with drive step 95 engaging drive engagement surface 82. The deflector bar 107 guides the selector key 94 to the left to a position of close approximation to pole piece 106.

If the needle pair assembly 44 is not to be utilized in the next tufting cycle, then selector coil 104 is not energized and accordingly, as the needle drive bar 88 rises, selector spring 108 will bias selector key 94 away from the needle pair assembly 44 so that the engagement notch surface 98 of selector key 94 will not engage selector latch lip 80 of the needle pair assembly 44. Thus, the selector key 94 will rise with needle drive bar 88 but free and clear of the needle pair assembly 44.

Figure 5:
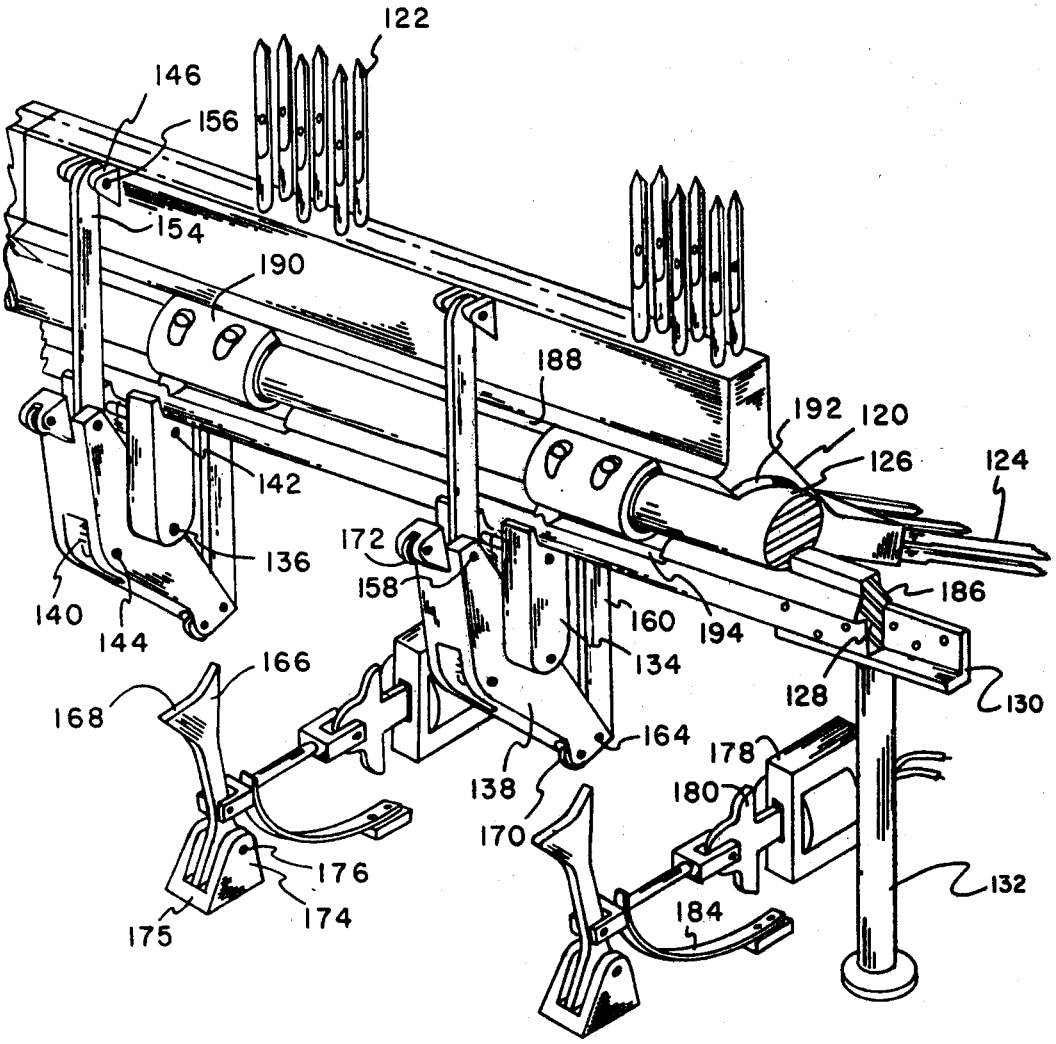
FIG. 5 is an isometric view of an alternate embodiment of needle selection means for the subject tufting machine.
Figure 5A:
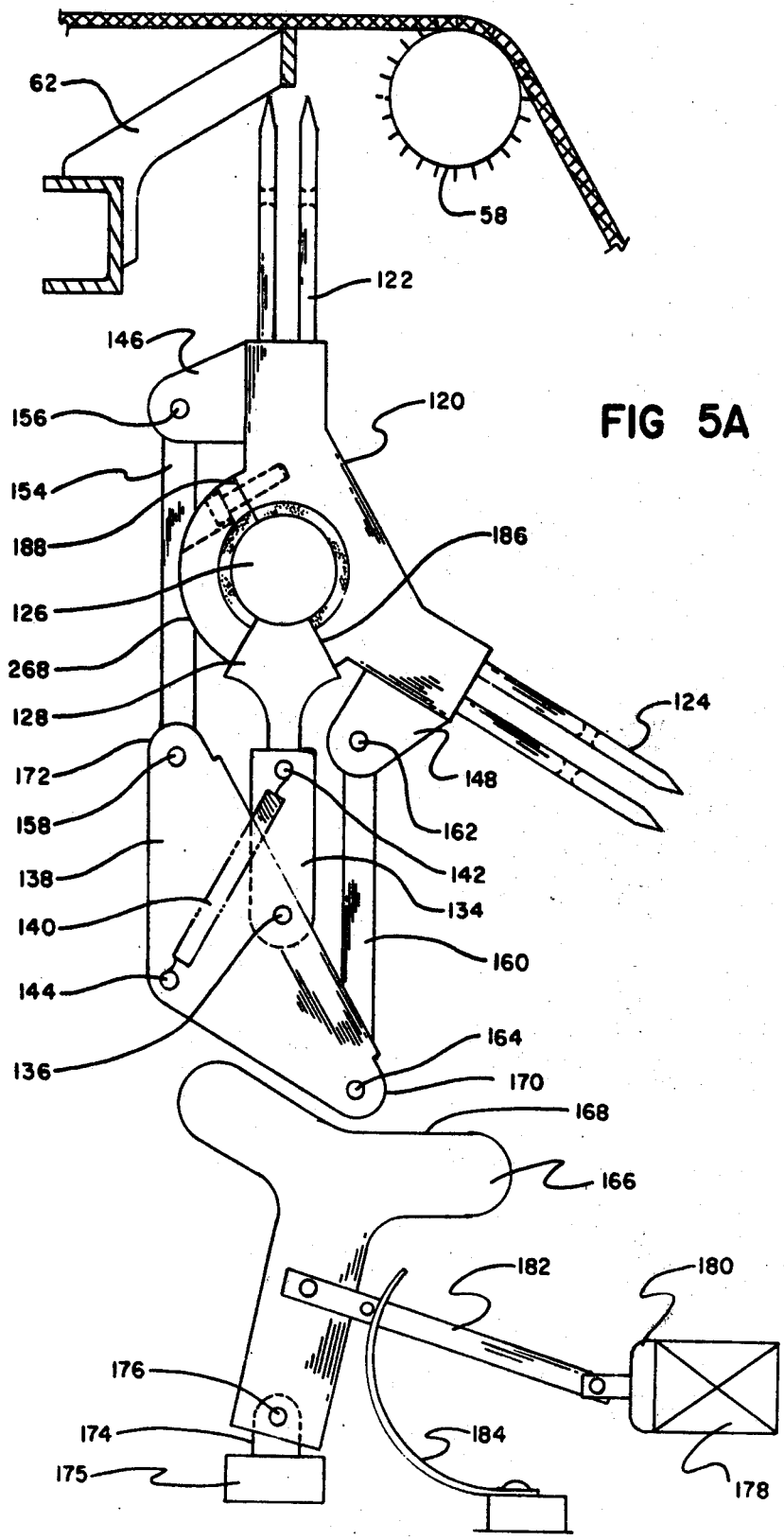
FIG. 5A is a plan view of a needle station of the embodiment of FIG. 5.

In place of the selectable needle embodiment of FIGS. 3 and 4, the selectable needle bar embodiment as disclosed in FIGS. 5 and 5A may be substituted. Needle bar segments 120, shown with each segment having two rows of needles 122,124, extend widthwise across the machine. As best seen in FIG. 5A, the needle bar segments 120 are mounted circumferentially around a pivot rod 126 which extends widthwise across the machine. The pivot rod 126 is rigidly secured or integral with carrier bar 128 which extends below the pivot rod 126 and is secured at intervals to support feet 130 (FIG. 5) which are mounted directly on the reciprocable needle bar push rods 132.

As best seen in FIG. 5A, pivot brackets 134 are secured to carrier bar 128 at intervals which coincide with corresponding needle bar segments 120. Pivotally mounted to each pivot bracket by pivot pin 136 is an over-center selector rocker 138. An over-center selector spring 140 is secured to pivot bracket 134 and to over-center selector rocker 138 by spring retainer pins 142 and 144 respectfully.

As can be further seen from FIG. 5A, each needle bar segment 120 has two connection link clevis members 146 and 148 positioned in close proximity to the two sets of needles 122 and 124. Connection link 154 is shown being secured to connection link clevis member 146 by pivot pin 156 and to over-center selector rocker 138 by pivot pin 158. Connection link 160 is shown pivotally connected to connection link clevis member 148 by pivot pin 162 and pivotally connected to over-center selector rocker 138 by pivot pin 164.

As seen from FIGS. 5 and 5A, each needle bar segment 120 and corresponding selector rocker 138 has a corresponding selector key 166 associated therewith. The selector key 166 has a grooved engagement surface 168 which corresponds to two engaging surfaces 170,172 on each selector rocker 138. The selector key 166 is pivotally mounted to selector key pivot clevis 174 by means of pivot pin 176 so as to pivotally mount the selector key 166 to plate structure 175 of the tufting apparatus. Each selector key 166 is actuated by a corresponding selector solenoid 178. A pole member 180 is secured to selector key 166 by connecting linkage 182. A spring 184 normally will bias the selector key 166 to a position where engagement surface 168 of selector key 166 will engage selector rocker surface 172 of selector rocker 138 which will initially be in a down position prior to engagement. This will cause needles 122 to be pushed upwardly to the tufting position as shown in FIG. 5A, as permitted by the restraining effect of connection links 154, 160. Needles 122 will be secured in this position by the action of over-center selector spring 140 until the spring bias is overcome. When the selector solenoid 178 is actuated attracting pole 180 to the solenoid, the bias of spring 184 will be overcome causing selector key 166 to pivot and engage surface 170 of selector rocker 138. As this surface 170 is engaged and pushed upwardly, the bias of over center spring 140 is overcome which will cause the needle bar segment 120 to rotate bringing needles 124 into the upward tufting position to the extent permitted by the restraining effect of connection links 154, 160. Needles 124 will be secured in this tufting position by the action of overcenter selector spring 140 until the spring bias is once again overcome.

As can be further seen in FIG. 5, the needle bar 120 is segmental with segments being secured by retainer caps 190 to pivot rods 126 with pivot bearings 192 mounted therein. As is necessary, carrier bar 128 has retainer cap clearance notches 194 to accommodate the retainer caps 190.

As can be appreciated, tufting needles 122 may be on a different gauge from tufting needles 124 or may otherwise be different such as in size or size of needle eye so that different types of yarn may be accommodated. If, for example, a rug is desired having two different densities, needles 122 may be aligned with every yarn feeding tube while needles 124 may be aligned with every other yarn feeding tube. When the needles 124 are in use, yarn will only be selected and fed for the corresponding tubes, i.e., every other tube which corresponds with the needles 124. Selection of the second set of needles can be made at any time and, of course, different sets of needles can be in use at different times since each needle bar segment 120 is independently controlled.

Figure 6:
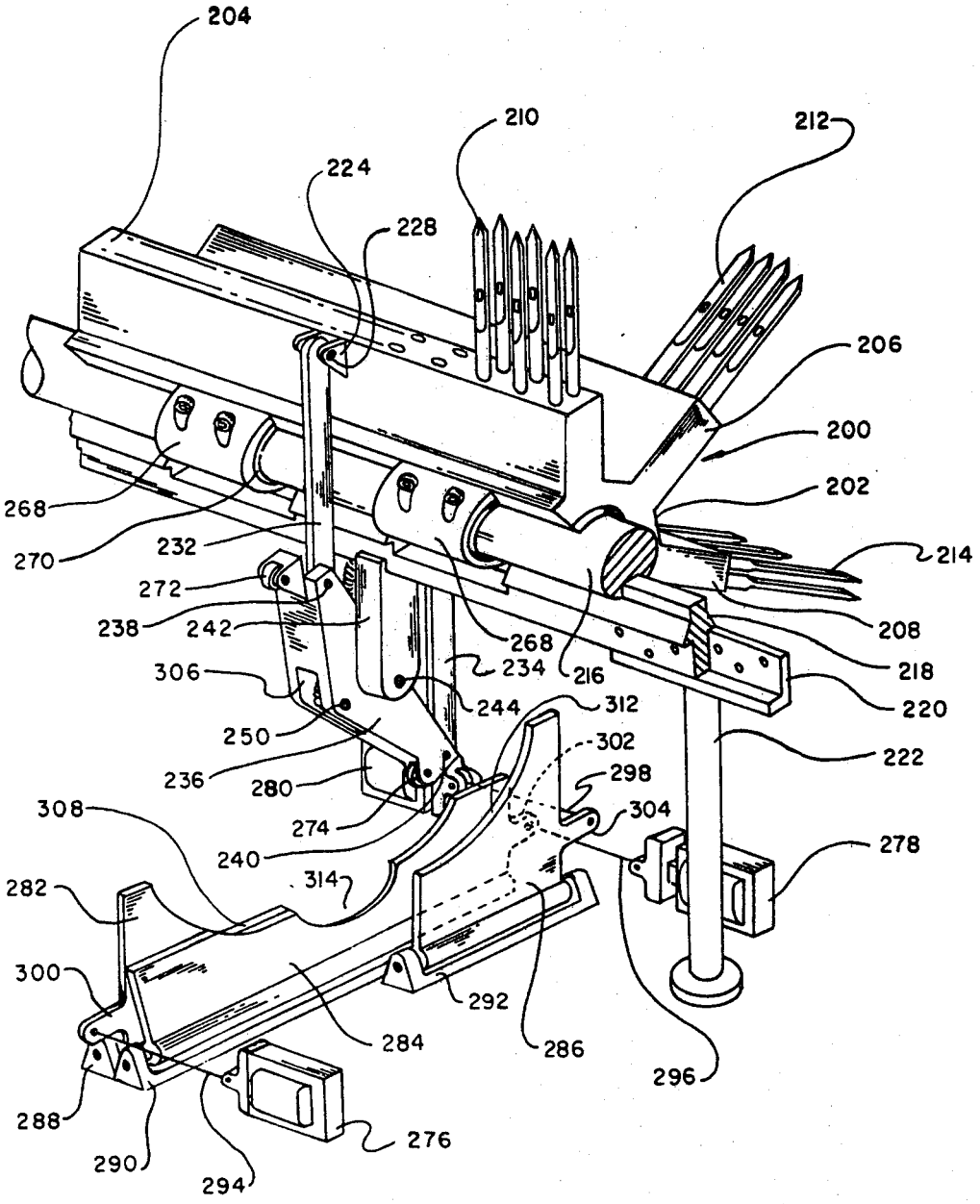
FIG. 6 is an isometric view of a further embodiment of a needle selection means.

With reference to FIG. 6, an alternative embodiment to the selectable needle bar of FIG. 5 is disclosed. As disclosed in FIG. 6, the selectable needle bar is a three tier needle bar. The needle bar 200 is divided into lengthwise needle bar segments 202 with each segment comprising three needle bar extensions 204,206 and 208, each of which house needle pairs 210,212 and 214, respectively. To facilitate further discussion, needles 210 and needle bar extension 204 will be referred to as No. 1 needles; needles 212 and needle bar 206 as No. 2 needles; and needles 214 and needle bar extension 208 as No. 3 needles. The needle bar segments 202 are mounted circumferentially around pivot rod 216 which is mounted securely to carrier bar 218. The carrier bar 218, in turn, is mounted to mounting foot 220 which is driven by reciprocating needle bar push rod 222.

As can be seen in FIG. 7, needle bar extensions 204 and 208 each have a connecting link clevis 224 and 226, respectively. Connecting links 232 and 234 are pivotally mounted to the connecting link clevis members 224 and 226, respectively, by pivot pins 228 and 230. The other ends of connecting links 232, 234 are pivotally mounted to an over-center selector rocker 236 by means of pivot pins 238,240, respectively. The over-center selector rocker 236 is pivotally mounted to pivot bracket 242 by pivot pin 244. As can be seen from FIG. 6, each individual needle bar segment 202 has corresponding selector rocker structure comprising the selector rocker 236 connecting links 232 and 234 and pivot bracket 242.

As shown in FIG. 7, an over-center spring 246 extends from spring retaining means 248 on carrier bar 218 to spring retaining means 250 mounted on over-center selector rocker 236. Carrier bar 218 has angulated position stops 252 and 254 which stop the motion of the needle bar segment 202 by engaging needle bar surfaces 253 and 255 respectively. Further, the carrier bar construction comprises a hardened steel plunger 256 (see FIG. 7A) which is spring loaded by means of spring 258 which extends into the bore 260 of carrier bar 218. A hardened steel insert 262 is found in each needle bar segment 202 directly below No. 2 needles. The steel insert 262 faces onto the pivot bar 216 and has a hollow aperture 264 which will receive the tip 266 of steel plunger 256 when No. 2 needles are to be selected as will be described in detail.

With further reference to FIG. 6, the needle bar 200 may be in incremental pieces and joined by retainer caps 268 and associated bearings 270.

With reference to FIGS. 6 and 7, the over-center selector rocker 236 has mounted thereon selector rollers 272, 274 which are utilized to select No. 1 and No. 3 needles, respectively.

With further reference to FIG. 6, actuation of the desired set of needles for tufting occurs through the use of solenoids 276,278, and 280 for selection of No. 1, No. 2 and No. 3 needles, respectively. For each of the needle bar segments 202 and the corresponding solenoid selectors 276, 278 and 280, there are three select cams 282, 284 and 286 for No. 1, No. 2 and No. 3 needles, respectively. The cams 282, 284 and 286 are pivotally mounted to the selector key pivot clevis members 288, 290 and 292, respectively. The cams may be mounted so that they are spring biases away from their respective solenoids. As can be seen, each solenoid 276, 278 and 280 has actuation wires 294, 296 and 298, respectively, leading to the wire connection tabs 300, 302 and 304 of the respective cams.

When not actuated, each of the cams 282,284 and 286 are inclined slightly so prominent parts of their surfaces do not engage either selector rollers 272, 274 or the central engagement area 306 of the over-center selector rocker 236. If, No. 1 needles are to be selected, solenoid 276 is energized causing actuation wire 294 to pull select cam 282 toward the solenoid and to a vertical position. As the needle bar push rod 222 lowers during the next cycle, selector roller 272 is engaged by cam engaging surface 308 of select cam 282 thus pushing No. 1 needles to the up or tufting position. The No. 1 needles are stopped in the tufting position by stop surface 255 of the needle bar segment 202 which engages surface 254 of carrier bar 218.

If on the next cycle, No. 3 needles are desired select cam 286 is actuated by solenoid 280 causing cam engaging surface 312 to impact against selector roller 274 as needle bar push rod 222 is lowered. Selector roller 274 and nearby portion of the over-center selector rocker 236 is pushed upwardly overcoming over-center spring 246 and causing the needle bar segment 202 to rotate bringing No. 3 needles to the upright or tufting position.

The No. 3 needles are stopped in the tufting position by stop surface 253 of the needle bar segment 202 which engages surface 252 of carrier bar 218.

If for the next cycle the No. 2 needles are desired solenoids 276 and 280 are inactuated so that select cams 282 and 286 are not vertical. Select cam 284 for No. 2 needles, will be actuated by solenoid 278, and therefore vertical. As the needle bar push rod 222 lowers during the cycle, the central engagement surface 306 of the selector rocker 236 will be engaged by surface 314 of cam 284 thus permiting steel plunger 256 to be brought to a position where tip 266 will be engaged in aperture 264 below of needle bar portion 206. The No. 2 needles will now be in position for tufting.

If in the next cycle needles No. 1 or 3 are selected the appropriate cam surface will engage with either selector roller 272 or 274 thus causing over-center spring 246 to unseat plunger 256 as the needle bar segment 202 rotates to the right or left depending upon whether needles No. 1 or 3 have been selected.

With reference to FIG. 8, the infinitely adjustable backing shifter of the subject tufting apparatus is disclosed. An adjusting arm 320 is shown having an adjusting or crank end 322 and a threadable end 324. The adjusting arm 320 is rotatably mounted to be driven by gear motor 326. Gear motor 326 is securely and rigidly mounted to a bearing surface 330.

The threadable end 324 of adjusting arm 320 is threadably received by set arm 332 which is adjustable to various vertical levels. The set arm 332 is slidably mounted within confining structure 334 that is in turn mounted to bearing wall 330. The adjustability of the backing shifter is enabled by a pivot lever 336 having an adjustable center pivot bearing 338 which position is obtained by the adjustment of set arm 332 which raises or lowers the adjustable center pivot bearing 338 as adjusting arm 320 is cranked.

The pivot lever 336 is pivotally mounted to connecting link 340 by pivot pin 342. A connecting link 340 is mounted to coupling 344 which permits the shifter shaft 58 to rotate as facilitated by linear bearings 346, 348. The base of pivot lever 336 is pivotally mounted to connecting link 350 by means of pivot pin 352. Connecting link 350 extends to cam follower 354, the latter which is engageable with cam drive 62 (see FIG. 2). Linear bearings 358, 360 are shown on connecting link 350.

It will be understood that once the adjustable center pivot bearing 338 is positioned or adjusted by means of adjusting arm 320, the cam drive will cause horizontal motion in connecting link 350, which will be transmitted in varying amplitude to connecting link 340 as determined by the position of adjustable center pivot bearing 338. Thus, with the rotating shifter shaft 58 being infinitely adjustable to provide programmable linear motion, the backing layer L may be shifted horizontally to determinable positions to receive each of the series of needle strokes.

The control of the subject tufting apparatus may be affectuated by a carpet pattern tape 370 as seen in FIG. 9. A carpet pattern tape 370 will contain pattern information 372 for yarn feed solenoids 33 (FIG. 10), information for backing layer advance spacing control 374 and information for backing shift control 376.

A reader head 378 which may be a photoelectric scanner, has a reader output area 380 to the solenoids of the yarn selectors/feeders which scans the necessary pattern information 372 to control the yarn feed. Additionally reader head 378 has reader output 382 to provide information for a backing advance electric gear or servo motor 77. The reader head 378 also has reader output 384 to provide information to the backing layer shifting gear or servo motor 326.

With reference to FIG. 10, an electronic control for the yarn feed system is disclosed. Yarn pattern information 372 is received from carpet pattern 370 by means of reader output 380 by the bank of solenoids 382 for a single tufting station. A bank of solenoid controls comprises individual solenoids 33 (see FIG. 2) for each of the yarn selection and length control stations 14. Solenoid 104 (see FIG. 4) is shown in FIG. 10 which control will always be actuated if a yarn is selected for one of the five individual yarn control solenoids 33. If a yarn is not to be tufted in a particular cycle, nonselection of all of the solenoids 33 will prevent the energization of solenoid 104 thereby causing needles 44 to remain in a rest position despite the reciprocation of needle bar 88 as occurs in each tufting cycle.

From the above, it will be appreciated that responsive to the pattern reader 378 a particular yarn strand from a selection or five or eight yarn strands may be selected for each needle station. From the pattern reader information the length of the strand may also be selected. The yarn is fed to the tufting station, severed, and tufted by needle assembly 44. If shaft carpet is being tufted, and less density is required, yarn may not be selected for a particular needle for one or more cycles. If this condition occurs as seen in FIG. 10 and none of solenoids 33 are actuated, then solenoid 104 for needle energization will not be activated.

In addition to the yarn color and length selection, yarn density is controlled by movement of the backing layer and from the pattern reader 378, the movement of pin rolls 56 and 59 are controlled. Thus, if shag is being tufted, the distance between succeeding rows may be greater and this condition controlled by the pattern reader for each incremental movement of the backing layer. In addition, if a particular pattern calls for the horizontal shifting of the backing layer for patterning affects, the rotating shifter shaft 58 can be controlled by the pattern reader 378 through the gear motor 326 as shown in FIG. 8. Thus, in the embodiment as disclosed in FIGS. 1–4, the choice of whether any of the needles are used is first available. Accordingly, every needle may be used, every other needle used, every third needle used, etc. Once it has been decided to use a particular needle, the color selection for that needle is a matter of choice or in place of different color yarns, yarns of different denier may be chosen. In addition to choosing the yarn for each needle stroke, the length of the particular yarn to be implanted is chosen. To further aid in density control the distance of a row of tufts from the preceding rows of tufts can be controlled as set forth above. Additionally, the entire row of tufts may be shifted by the backing shifter shaft 58 to promote the appearance of the rug.

In place of the embodiment shown primarily in FIGS. 3 and 4 where each individual needle may be selected, the two needle embodiment of FIGS. 5, 5A and the three needle embodiment of FIGS. 6 and 7 may be used. With these two latter embodiments, it will be appreciated that, as for example in FIG. 6, needles 210 are spaced at different needle intervals from needles 212 which are in turn spaced at different intervals from needles 214. If narrow gauge carpet is to be tufted, then the needles spaced closer will be used while for the longest shag, the needles spaced furtherest apart will be used. The use of solenoids 276,278,280 is controlled in the same manner as solenoid 104 of the embodiment of FIG. 3. That is, once it has been determined whether yarn is to be supplied to particular needles, one of the needle sets is chosen by the condition of whether yarn is being fed or not. Such needle contruction avoids needles being utilized without yarn which utilization would tend to needlessly puncture the backing layer weakening and damaging the final product.

With reference to FIG. 11, the adaptation of the embodiment of FIG. 3 to a conventional tufting machine is disclosed. Backing supply roll 400 is shown with the backing layer L extending around alignment roll 402 to feed pin rolls 404, 406. The tufted product is pulled from feed pin roll 406 by doff roll 408. Yarn is supplied from creel 410 and extends to the needle station through yarn guides 412, 414, 416 and 418. A single conventional tufting needle 420 receives the yarn after it passes through a conventional one way yarn valve 422. Beneath the backing layer a standard looper 424 receives the yarn once tufted and cutter 426 coacts with looper 424 to provide cut pile carpet. The looper 424 is shown driven by conventional looper drive components 428 while cutter 426 is shown driven by conventional cutter drive components 430.

The needle selection device of FIG. 11 is essentially the same as that of FIG. 3 only in an inverted position. Stationary block 432 receives needles 420 which needles are driven by needle bar 434. The needle bar 434 reciprocates as driven by push rod 436 which extends to cam drive 438. The structure is placed within support structure 440. A solenoid 442 on the order of solenoid 104 of FIG. 3 is shown placed adjacent selector key 444 which corresponds to selector key 94 of FIG. 3. A deflector bar 446 serves the same purpose as deflector bar 107 of FIG. 3. Needle engaging structure 448 attached to needle 420 provides the engaging surface for selector key 444 if the subject needle is energized by solenoid 442. A spring 450 is disclosed which serves to hold needle 420 in an up position unless solenoid 442 is energized to cause selector key 444 to drive needle 420 downwardly as needle bar 434 reciprocates. From the detailed description of FIG. 3, it will readily be appreciated that needle 420 can be used on each downward reciprocation of needle bar 434 or how tufts need not be made if so dictated by pattern control.

The present invention may be embodied in other specific forms without departing from the spirit or essential attributes thereof, and accordingly, reference should be made to the appended claims, rather than to the foregoing specification as indicating the scope of the invention.

I claim:

1. A method of producing a tufted product by an automatic tufting machine comprising the steps of:

(a) selecting a location for each tuft not necessarily in row-like regimentation;

(b) choosing at each selected location whether or not to implant a tuft therein;

(c) selecting a yarn of choice for each tuft to be implanted;

(d) selecting a length of choice for each selected yarn; and, (e) implanting the tufts into a backing layer.

2. The method of claim 1 wherein selecting a location for each tuft comprises the step of adjusting advancement of the backing layer.

3. The method of claim 2 wherein selecting a location for each tuft comprises the further step of adjusting lateral movement of the backing layer.

4. The method of claim 1 wherein choosing whether or not to implant a tuft comprises the step of controlling whether yarn is selected and fed to a tuft applying element.

5. The method of claim 4 wherein choosing whether or not to implant a tuft comprises the further step of actuating or not actuating a selectable tuft applying element.

6. The method of claim 1 wherein choosing whether or not to implant a tuft comprises the further step of choosing one of a plurality of available tuft applying elements.

7. The method of claim 6 wherein the step of choosing one of a plurality of available tuft applying elements comprises the further step of rotating a selected tuft applying element into position to tuft.

8. The method of claim 1 wherein the step of selecting a yarn of choice further comprises the step of selecting a yarn of chosen color by actuating a yarn selection control based upon data of pictorial to be reproduced.

9. The method of claim 1 wherein the step of selecting a length of choice for each selected yarn comprises the further step of metering and feeding the chosen desired length of yarn to the tuft applying element.

* * * * *